US009136588B2

(12) United States Patent
Grossman et al.

(10) Patent No.: US 9,136,588 B2
(45) Date of Patent: Sep. 15, 2015

(54) SYSTEM AND METHOD FOR SHORT UHF ANTENNA WITH FLOATING TRANSMISSION LINE

(71) Applicant: MOTOROLA SOLUTIONS, INC, Schaumburg (IL)

(72) Inventors: Ovadia Grossman, Tel Aviv-Yaffo (IL); Antonio Faraone, Fort Lauderdale, FL (US); Alexander Oon, Bayan Lepas (MY); Mark Rozental, Gedera (IL)

(73) Assignee: Motorola Solutions, Inc., Schaumburg, IL (US)

( * ) Notice: Subject to any disclaimer, the term of this patent is extended or adjusted under 35 U.S.C. 154(b) by 213 days.

(21) Appl. No.: 13/948,709

(22) Filed: Jul. 23, 2013

(65) Prior Publication Data

US 2015/0029059 A1 Jan. 29, 2015

(51) Int. Cl.
*H01Q 9/04* (2006.01)
*H01Q 1/24* (2006.01)

(52) U.S. Cl.
CPC ..... *H01Q 1/243* (2013.01)

(58) Field of Classification Search
CPC ..... H01Q 9/30; H01Q 21/10; H01Q 9/16
USPC ..... 343/791, 900, 843, 702
See application file for complete search history.

(56) References Cited

U.S. PATENT DOCUMENTS

| | | | | |
|---|---|---|---|---|
| 5,181,044 | A | 1/1993 | Matsumoto et al. | |
| 6,211,831 | B1 * | 4/2001 | Nagy et al. | 343/713 |
| 8,390,526 | B1 * | 3/2013 | O'Connell et al. | 343/791 |
| 8,489,162 | B1 * | 7/2013 | Dou et al. | 455/575.7 |
| 2003/0122716 | A1 | 7/2003 | Ellis et al. | |
| 2010/0201597 | A1 * | 8/2010 | Okui et al. | 343/843 |
| 2012/0112980 | A1 * | 5/2012 | Kaikkonen et al. | 343/867 |
| 2012/0194401 | A1 * | 8/2012 | McLean et al. | 343/792 |
| 2013/0082879 | A1 | 4/2013 | Fuchs et al. | |

FOREIGN PATENT DOCUMENTS

TW 1239677 B 11/2004

* cited by examiner

*Primary Examiner* — Dameon E Levi
*Assistant Examiner* — Collin Dawkins
(74) *Attorney, Agent, or Firm* — Barbara R. Doutre; Steven A. May; Daniel R. Bestor

(57) ABSTRACT

A short, efficient antenna utilizing a floating coax transmission line over ground or overlapping wire feed structure for reduced antenna size for use in handheld radios. An asymmetric transmission line radiator having a length ($L_{TL}$) is oriented substantially planar to and proximal to a truncated ground plane, and having at one end an input/output connector, and at an other end a feed point at least one of above a ground plane and proximal to its edge. An exciter antenna in a form of a plate or bent wire is coupled to the feed point and is exterior to the edge of the ground plane and oriented substantially orthogonal to the ground plane, the exciter antenna having a larger dimension length ($L_{EA}$) that is at least 50% smaller than the length $L_{TL}$. The overall length of a perimeter of the antenna is approximately ½ a wavelength of a center frequency of the antenna.

20 Claims, 14 Drawing Sheets

SYSTEM AND METHOD FOR SHORT UHF ANTENNA WITH FLOATING TRANSMISSION LINE

BACKGROUND OF THE INVENTION

Current antenna design for mobile devices is directed to extracting more radiator length from a given radiator size, examples being a helix or meander radiator. This typically leads to poor bandwidth and low gain. Also, due to size limitations in mobile devices, efficient antennas are too large to be located within the mobile device, typically being attached to a top portion thereof. Numerous designs have been developed for small antennas, but all are understood to be subject to some performance compromise, whether it be bandwidth, gain, radiation efficiency, impedance, etc. Therefore, there has been a longstanding need in the mobile radio devices community for a versatile, small antenna with reasonable performance characteristics.

In view of the above, the following description details new electrically small, antenna system(s) and method(s) with performance characteristics that are superior to comparable sized antennas.

DETAILED DESCRIPTION

Figure 1:
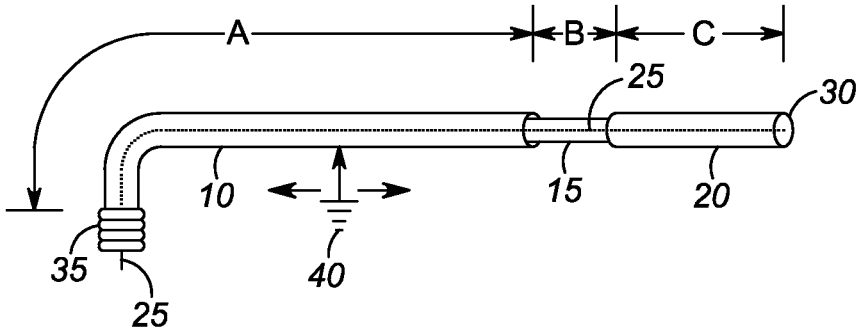
FIG. 1 is a see-through illustration of an embodiment of an antenna using an asymmetrical transmission line radiator with a capped coaxial radiator.

In one aspect of the disclosed embodiments, an electrically short, cable based antenna is provided, comprising: a truncated ground plane; an asymmetric transmission line radiator having a length ($L_{TL}$) oriented substantially planar to and proximal to the ground plane, the transmission line also having at one end an input/output connector, and at an other end a feed point at least one of above a ground plane and proximal to its edge; and an exciter antenna in a form of a plate or bent wire coupled to the feed point and disposed exterior to the edge of the ground plane and oriented substantially orthogonal to the ground plane, the exciter antenna having a larger dimension length ($L_{EA}$) that is at least 50% smaller than the length $L_{TL}$, wherein an overall length of a perimeter of the antenna is approximately ½ a wavelength of a center frequency of the antenna.

In yet another aspect of the disclosed embodiments, a method for fabricating an electrically short, cable based antenna is provided, comprising: truncating a ground plane; placing an asymmetric transmission line radiator having a length ($L_{TL}$) substantially planar to and proximal to the ground plane, the transmission line also having at one end an input/output connector, and at an other end a feed point proximal to an edge of the ground plane; and coupling an exciter antenna in a form of a plate or bent wire to the feed point and disposing the exciter antenna exterior to the edge of the ground plane in an orientation substantially orthogonal to the ground plane, the exciter antenna having a larger dimension length ($L_{EA}$) that is at least 50% smaller than the length $L_{TL}$, wherein an overall length of a perimeter of the antenna is approximately ½ a wavelength of a center frequency of the antenna.

The principles governing the overall current distributions of the antenna embodiments described herein are a modification of those found in planar inverted F antennas (PIFA) and inverted F antennas (IFA), which are known to operate as full size quarter wave antennas over large ground planes with standard feed forms. Therefore, these quarter wave antennas are limited in their ability to be reduced in size.

The new antenna embodiments disclosed herein are, generally speaking, a "twisted" version of the PIFA/IFA structure but include a floating asymmetrical (e.g., coaxial) feed structure that allows a lower operating frequency. Due to the additional energy radiated by the floating coaxial feed structure and its transformer properties, these antenna embodiments can be much smaller than prior art antennas with nearly equivalent or better performance characteristics. In some instances, the disclosed antennas can be up to ten times smaller than the current state-of-the-art. In reference to certain features and/or structures shown in the following FIGS., it is understood that they may not be drawn to scale, the appropriate proportions being easily devisable to one of ordinary skill in the art.

FIG. 1 is a see-through illustration of an embodiment of an antenna using an asymmetrical transmission line radiator with a capped coaxial radiator. The asymmetrical transmission line radiator includes a coaxial cable 10 of length A, with adjoining unshielded center conductor 15 of length B, and adjoining as a feed point to coaxial radiator 20, having center conductor 25 capped to a shield connection 30, of length C. Signal received/transmitted by the antenna is conveyed to radio circuitry (not shown) via coupler 35 situated at a lower end of coaxial cable 10. In some embodiments, a grounding connection/clip 40 can be implemented that is adjustable along coaxial cable 10, and can be used to adjust the center frequency ($f_c$).

The $f_c$ is principally determined by the coaxial length A+B and will be approximately a free-space quarter wavelength ($\lambda/4$) (noting that the internal coaxial cable wavelength is a function of the characteristic impedance $Z_0$, being nearly $\lambda/6$ for most radio grade coaxial cables). Length C generally will be smaller than A+B, being usually one quarter (¼) to one third (⅓) the length of A+B. Of course, depending on the implementation, the proportions may vary, as evident to one of ordinary skill in the art. Length B can be arbitrary, representing the source point connection to the coaxial radiator 20. It is understood, however, that length C may be adjusted to effect a certain degree of matching to the coaxial radiator 20.

In some embodiments, the length A+B portion (10, 15) acts as a $\lambda/4$ transformer to the coaxial radiator 20, however, in addition to the radiating currents on the coaxial radiator 20, "unbalanced" radiating currents will travel along the shield portion of coaxial cable 10 to ground via coupler 35, effectively adding another radiator to the system. Thus, a superpositioning of the two radiating currents can be arranged form constructive fields for more radiation of energy.

Figure 2:
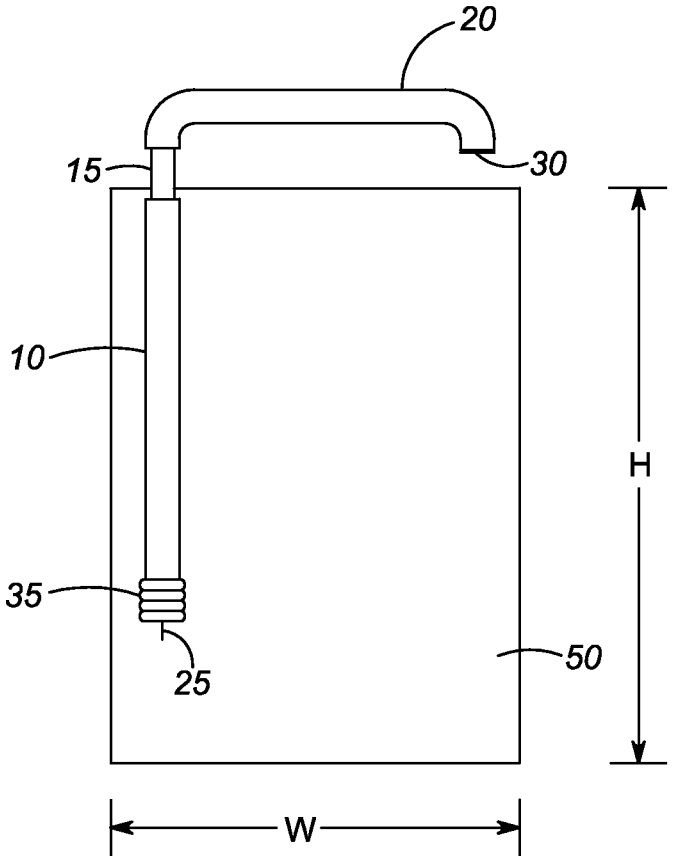
FIG. 2 is an illustration of an implementation of the antenna of FIG. 1.

FIG. 2 is an illustration of an implementation of the antenna of FIG. 1, showing asymmetrical transmission line 10 with coaxial coupler 35 and exposed center conductor 25, with unshielded center conductor section 15 adjoining as a feed point to "bent" coaxial radiator 20 with center conductor-to-outer shield cap 30, over truncated ground plane 50. The bending of the coaxial radiator 20 provides current distribution characteristics similar to a PIFA/IFA antenna, but due to the asymmetrical transmission line 10, the overall antenna can be significantly smaller. The truncated ground plane 50 can be the backplane of radio circuit board and affords image currents, allowing for better performance characteristics. As is apparent, the bending of the coaxial radiator 20 over the top edge of the truncated ground plane 50, allows this antenna to be conformed to a standard mobile radio profile.

In experimental models for frequencies in the mobile communications UHF band (e.g., approximately 380-520 MHz), using a truncated ground plane with width W of 5 cm and height H of 10 cm, using 50 Ohm and 75 Ohm coaxial lines, length A was designated as approximately 12 cm, length B as approximately 2 cm, and length C as approximately 7 cm with acceptable results. It should be expressly noted that the above dimensions, separations, sizes, etc. are frequency dependent, accordingly, if other frequency bands or performance characteristics are desired, then the associated parameters will be need to be appropriately altered. For example, the separation distance between the coaxial radiator 20 from the top edge of the truncated ground plane 50 can be varied, with higher radiation efficiency discovered for a distance of 2.5 cm and lower radiation efficiency for a distance of 10 mm.

Figure 3:
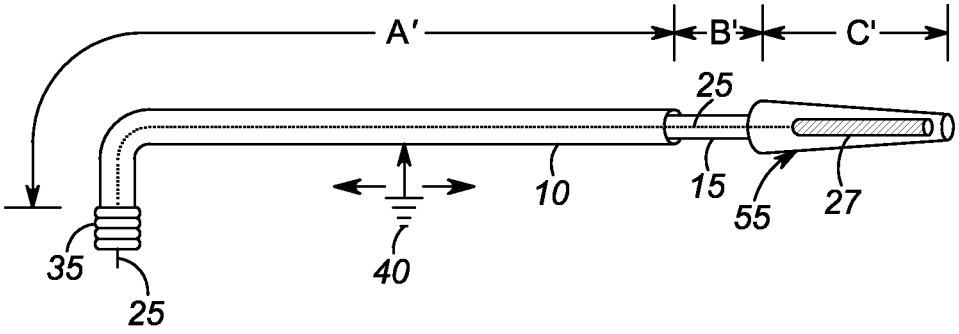
FIG. 3 is a see-through illustration of another embodiment of an antenna using an asymmetrical transmission line radiator with a standard antenna stub.

FIG. 3 is a see-through illustration of another embodiment of an antenna using an asymmetrical transmission line radiator, however hybridized with a standard antenna stub. The asymmetrical transmission line radiator is composed of a coaxial cable 10 of length A', with adjoining unshielded center conductor 15 of length B', and adjoining as a feed point to antenna stub 55 having center conductor 25 terminated with a radiator 27 of length C'. Signal received/transmitted by the antenna is conveyed to radio circuitry (not shown) via coupler 35 situated at a lower end of coaxial cable 10. In some embodiments, a grounding connection/clip 40 can be implemented that is adjustable along coaxial cable 10, and can be used to adjust the center frequency ($f_c$). The radiator 27 can be a conventional short radiator (e.g., helical, loaded, etc.), permitting the antenna to be coupled to standard top mounted short radiators.

Figure 4:
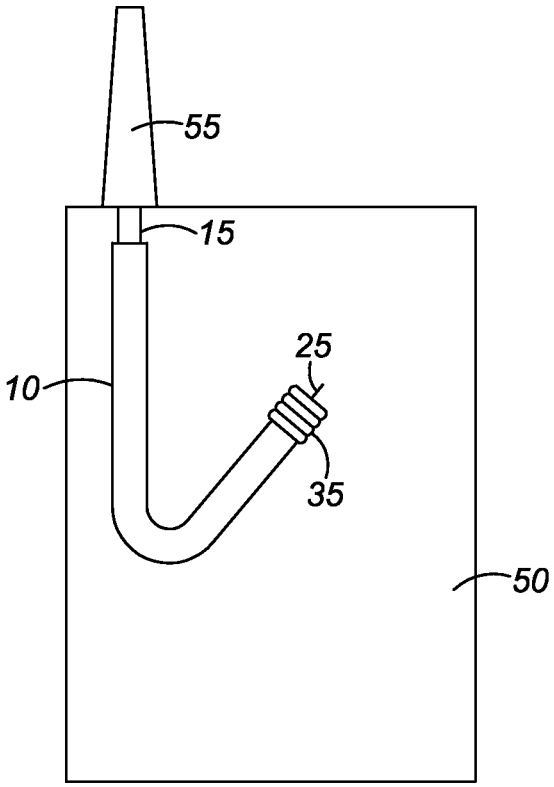
FIG. 4 is an illustration of an implementation of the antenna of FIG. 3.

FIG. 4 is an illustration of an implementation of the antenna of FIG. 3, showing asymmetrical transmission line 10 curved over truncated ground plane 50 with coaxial coupler 35 and exposed center conductor 25, with unshielded center conductor section 15 adjoining as a feed point to antenna stub 55. This configuration is shown to illustrate the applicability of the asymmetrical transmission line 10 design to standard top mounted antennas within the context of a mobile radio system (having a truncated ground plane 50), and also to show that, in some embodiments, asymmetrical transmission line 10 can be placed in a non-linear fashion over the truncated ground plane 50. The non-linear orientation of the asymmetrical transmission line 10 enables a longer line (e.g., having larger wavelength or lower frequency capability) to be fitted within the confines of the truncated ground plane 50.

Figure 5:
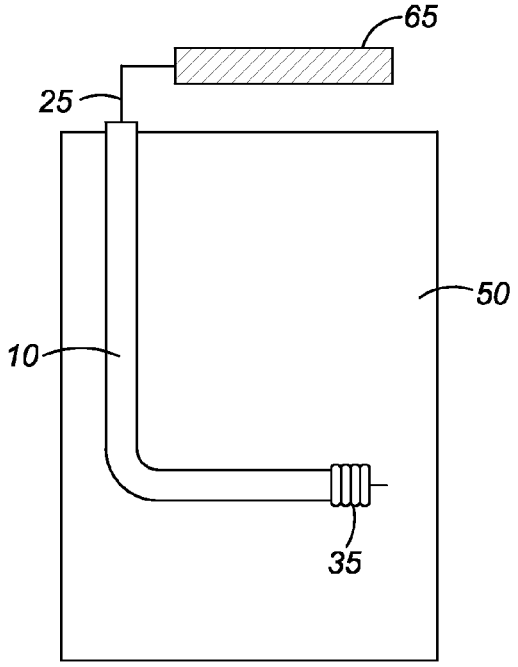
FIG. 5 is an illustration of another antenna embodiment with a conventional antenna stub oriented parallel to the ground plane.

FIG. 5 is an illustration of another antenna embodiment, wherein the top radiator is a conventional antenna stub 65 oriented parallel to the top edge of ground plane 50. Asymmetrical transmission line 10 is curved over truncated ground plane 50 with coaxial coupler 35 and center conductor 25 "feed pointing" the antenna stub 65. This illustration reduces the overall form factor as compared to FIG. 4's embodiment.

Figure 6:
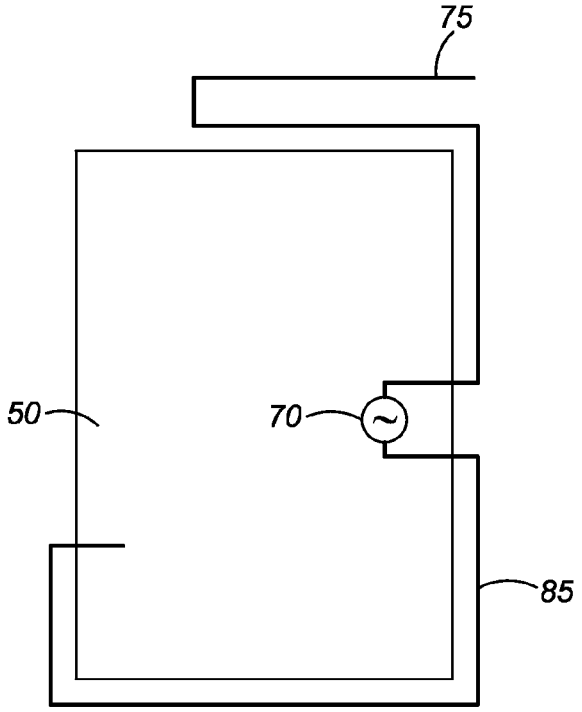
FIG. 6 is an illustration of another antenna embodiment with a top looped wire and bottom bent wire.

FIG. 6 is an illustration of another antenna embodiment, wherein the top radiator 75 is a looped wire antenna above truncated ground plane 50, with bottom radiator 85 as a bent wire antenna below truncated ground plane 50, both wires being excited by source 70. The looping of the top radiator 75 and bending of the bottom radiator 85 allows for a compact antenna configuration that is conformal to the dimensions of the truncated ground plane 50. This design enables longer wavelength antennas to be "compressed" within a smaller form factor and presents a dipole-like antenna configuration with interesting possibilities as further explored below. For certain embodiments of mobile band UHF frequencies, the bottom radiator 85 should be at least 3 mm above the truncated ground plane 50.

Figure 7:
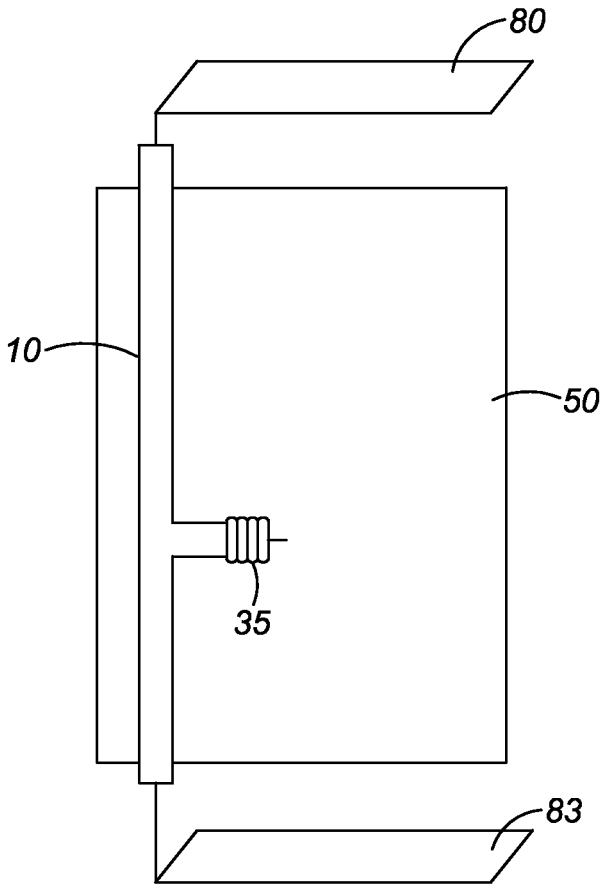
FIG. 7 is an illustration of another antenna embodiment with a perpendicular plate top radiator and bottom perpendicular plate.

FIG. 7 is an illustration of another antenna embodiment with an asymmetrical transmission line 10 over truncated ground plane 50 coupled to a top radiator 80 in the shape of a perpendicular plate antenna and coupled to a bottom radiator 83 also in the shape of a perpendicular plate antenna. Coaxial coupler 35 provides connection to an associated RF section of a radio (not shown). As can be seen, this is an extension of the embodiment shown in FIG. 6, wherein the looped/bent wires are proxied with plates. The plates of top and bottom radiators 80, 83 are displaced from the truncated ground plane 50 and are configured with a surface area that corresponds to approximately $\lambda/4$ the $f_c$. The plates are oriented to be substantially perpendicular or orthogonal to the truncated ground plane 50, permitting the top/bottom radiators 80, 83 to be fitted within/proximal to the top and bottom portion, respectively, of a standard mobile radio housing. Accordingly, the general form factor of a standard mobile radio does not need to be significantly, if at all, altered to accommodate the described antenna. The bottom radiator 83 is sometimes referred to in the art as a ballast antenna, and is present in only some embodiments. The bottom radiator 83 increases performance characteristics by allowing for correct phasing of currents at main radiator 80 as well as on the bottom radiator 83. It further provides a double compensated loading of the respective input to the radiators 80, 83 to increase the bandwidth in some cases by double, and gain improvement in some cases by 1.5 dB.

Figure 8:
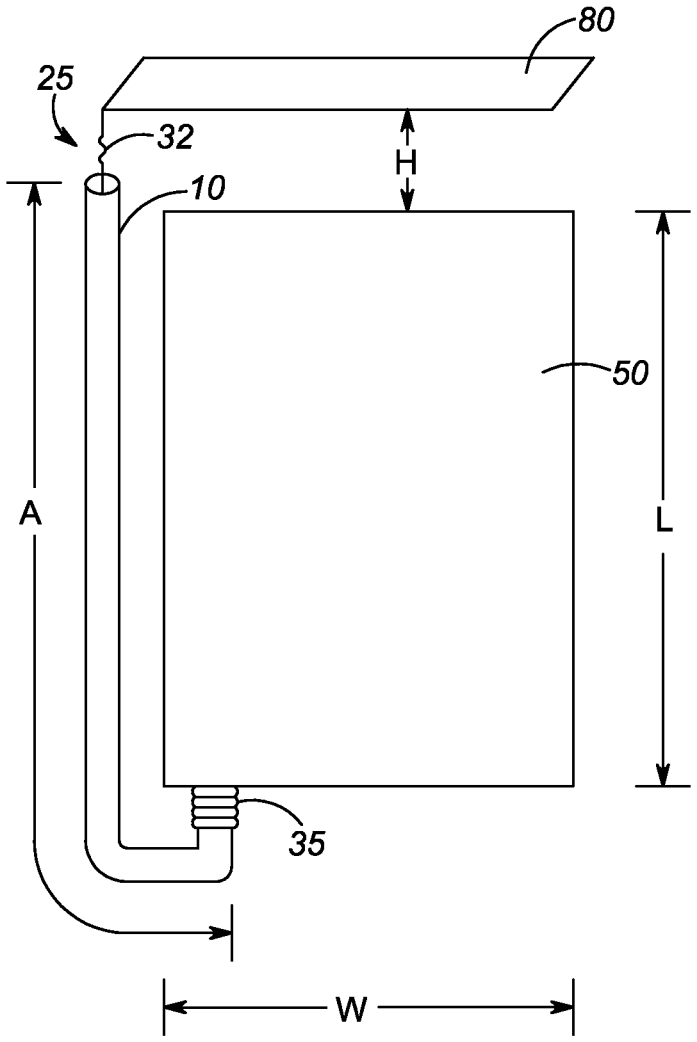
FIG. 8 is an illustration of another antenna embodiment with a perpendicular plate top radiator and matching tuner.

FIG. 8 is an illustration of another antenna embodiment with an asymmetrical transmission line 10 of length A over truncated ground plane 50 coupled to a top radiator 80 in the shape of a perpendicular plate antenna displaced from the top edge of truncated ground plane 50 by a distance H, with a matching network or tuning element 32 coupled to center conductor 25. A coaxial coupler 35 is at the radio-side end of the asymmetrical transmission line 10, for connection to the radio's RF input/output (not shown). The matching network/tuning element 32 can provide impedance matching and/or frequency adjustment and can be a capacitor, inductor, etc. This embodiment is configured to allow radiation with minimal current cancelation. For quarter wave transformer operation, the characteristic impedance of the asymmetrical transmission line 10 can be below 50 Ohms, for example, 30-40 Ohms, to allow matching between the top radiator 80 (having in this case an impedance of 15 Ohms) and the input radio port impedance 50 Ohms. As an aside, it is noted that while the interior of the asymmetrical transmission line 10 can have a low impedance, the exterior of the asymmetrical transmission line 10 over the truncated ground plane 50 can have an impedance of over 100 Ohms—recognizing that a higher outer impedance will provide more efficient radiation for the external "unbalanced" currents.

For this embodiment, a good rule of thumb is that the perimeter of the antenna translates to approximately the half wavelength of the center frequency. For example, for an embodiment suitable for the mobile communications UHF band (e.g., approximately 380-520 MHz), the truncated ground plane 50 was designed with a height of 10 cm and a width of 5 cm. The top radiator 80 was 10 mm×50 mm with a separation distance of approximately 2.5 cm from the top of the truncated ground plane 50. In this case the perimeter is approximately (10 cm+2.5 cm)*2+(5 cm)*2=35 cm, corresponding to the half wavelength, wherein the center frequency would then be approximately 428 MHz. Having equal proportions along the sides of the perimeter of the antenna is understood to provide better performance characteristics (e.g., top+side 1=bottom+side 2). In some embodiments, the center frequency is obtained by having a length A of the asymmetrical transmission line 10 as approximately ⅙ the free space center wavelength, with the internal impedance of the asymmetrical transmission line 10 devised so that the length A corresponds to approximately ¼ the internal center wavelength.

The center frequency can also be altered by trimming the asymmetrical transmission line 10. For increased efficiency (e.g., above 50%), the top radiator 80 should be separated from the truncated ground plane by approximately 0.05 wavelength or more.

Figure 9:
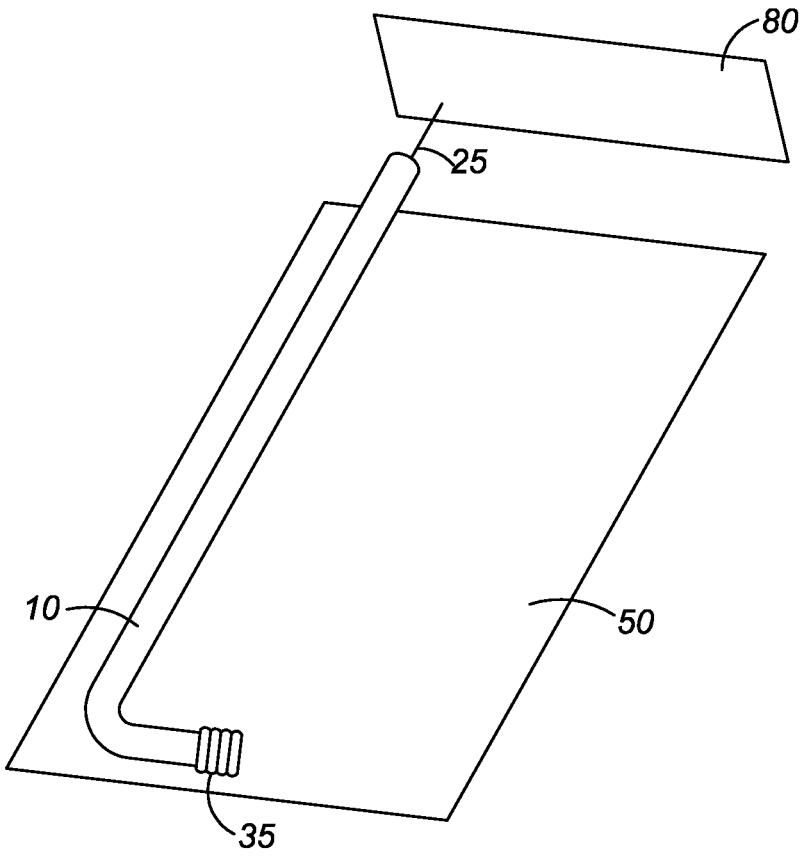
FIG. 9 is an perspective view of an embodiment of FIG. 8.

FIG. 9 is a perspective view of an embodiment of FIG. 8, showing the asymmetrical transmission line 10 above truncated ground plane 50 with top radiator 80 in a perpendicular or orthogonal orientation with respect to the truncated ground plane 50. Center conductor 25 (without a matching network or tuning element) operates as the feed point to the truncated ground plane 50, while coaxial connector 35 affords input and/or output connection to radio electronics (not shown).

Figure 10:
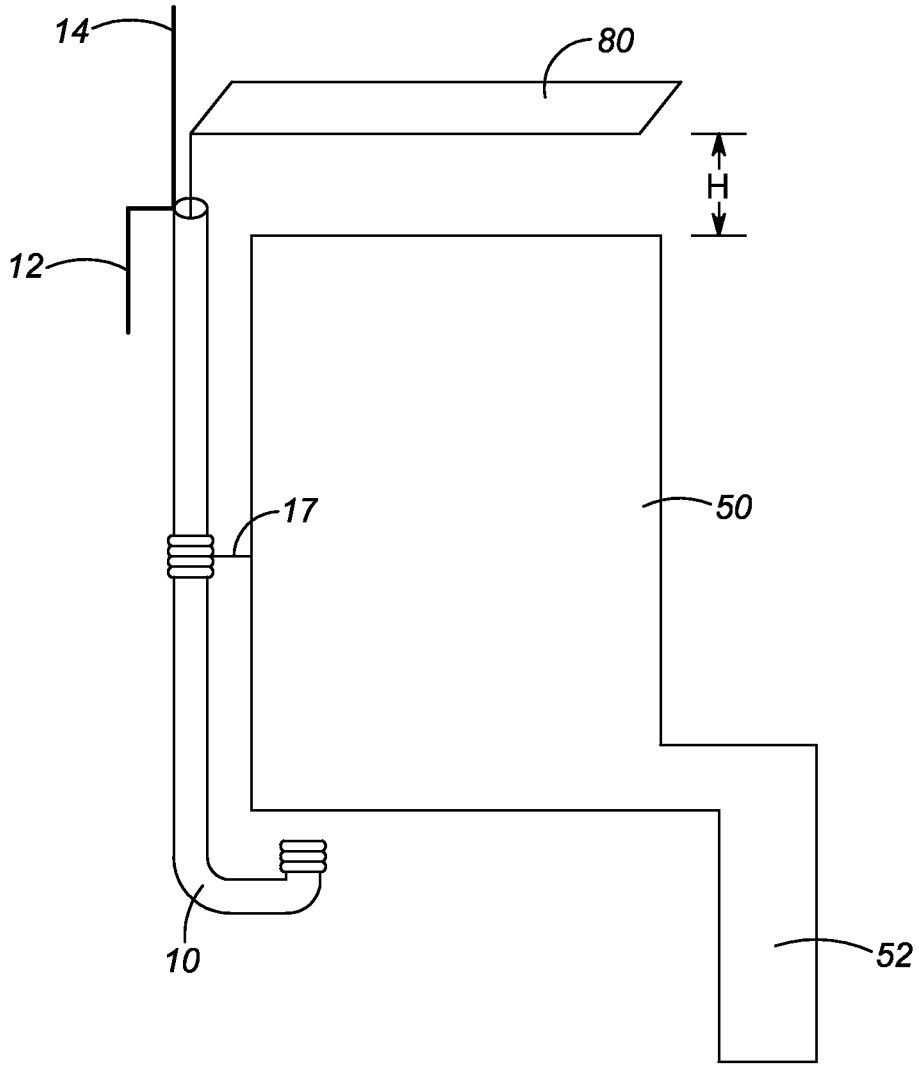
FIG. 10 is an illustration of another antenna embodiment showing various possible modifications to the embodiments of FIGS. 8-9 for frequency/gain alteration.

FIG. 10 is an illustration of another antenna embodiment showing various possible modifications to the embodiments of FIGS. 8-9 for frequency/gain alteration. For example, an extension of the shield of the asymmetrical transmission line 10 can be achieved by adding a lower protrusion/wire 12 (which interacts with the truncated ground plane 50 to alter the center frequency), as well as an upper protrusion/wire 14. Also, truncated ground plane 50 can be extended 52 to allow for more image currents and to alter the impedance between shield of the asymmetrical transmission line 10 and the truncated ground plane 50. As noted in the earlier embodiments, an adjustable ground clip 17 can be affixed to the shield of the asymmetrical transmission line 10, to reduce the electrical length of the exterior of the asymmetrical transmission line. The frequency can also be altered by reducing the separation distance of the top plate radiator 80 as well as shortening/lengthening the asymmetrical transmission line 10

Figure 11:
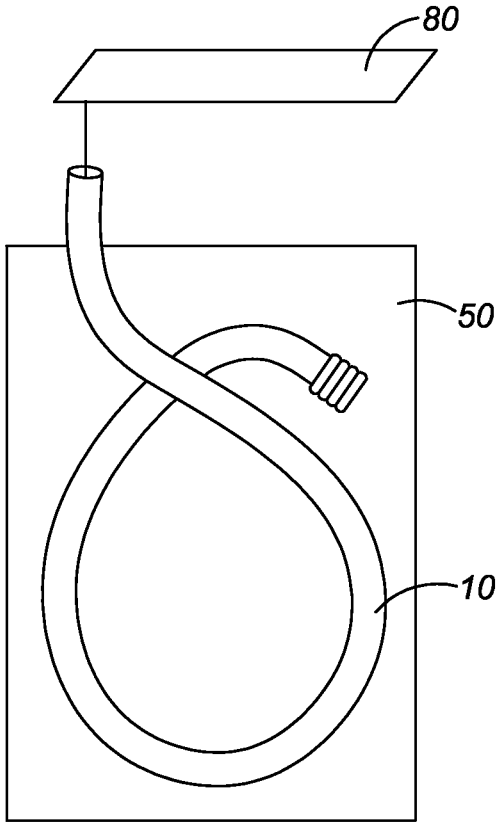
FIG. 11 is an illustration of another antenna embodiment with a curled asymmetrical transmission line.

FIG. 11 is an illustration of another antenna embodiment, wherein the asymmetrical transmission line 10 is curled within the framework of the truncated ground plane 50, with top plate radiator 80 coupled to the asymmetrical transmission line 10. This embodiment contemplates a wider bandwidth by utilizing a longer asymmetrical transmission line 10. However the overall form factor is equivalent to the other embodiments by virtue of the coiling of the asymmetrical transmission line 10. It is noted that the "broader" the coiling (i.e., closer to the edges of the truncated ground plane 50), the separation of the currents will be better resulting in better performance.

Figure 12:
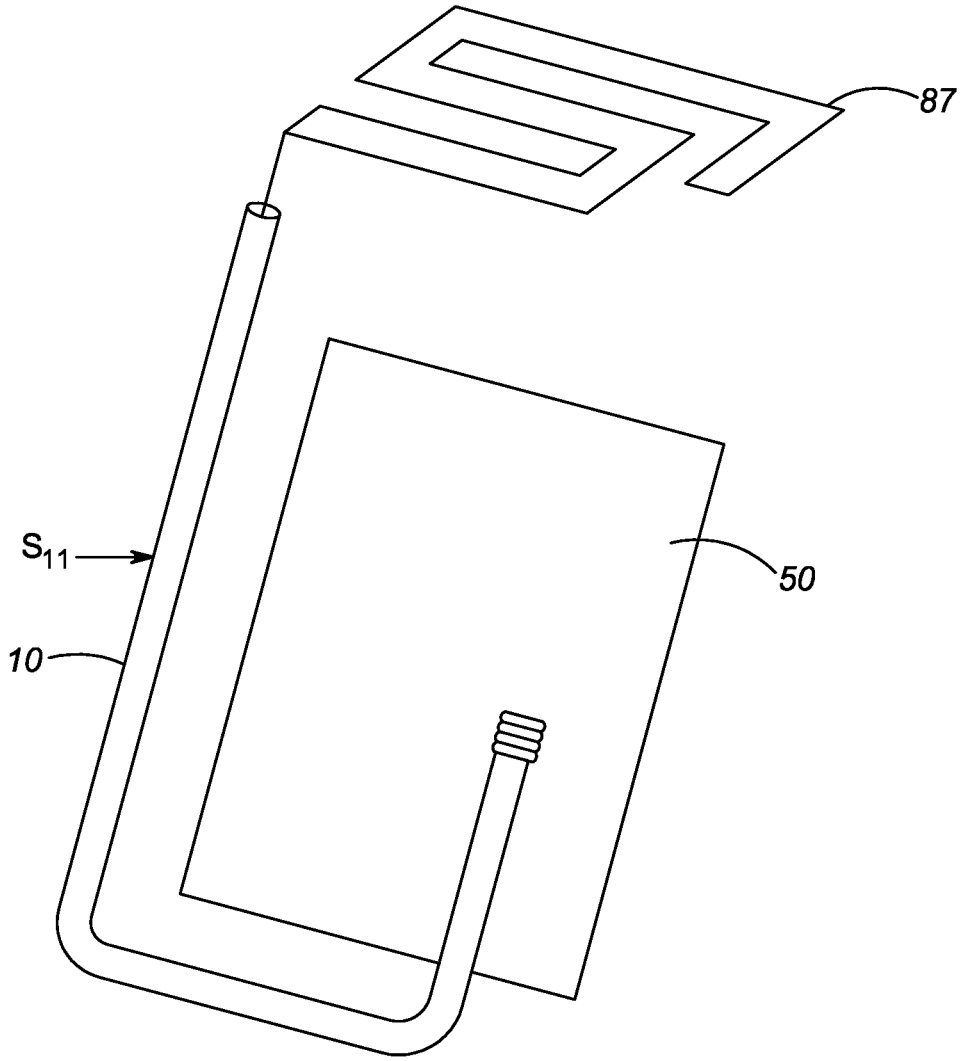
FIG. 12 is an illustration of another antenna embodiment with a top meandering strip.

FIG. 12 is an illustration of another antenna embodiment, wherein the top plate radiator is approximated by a meandering strip 87. Further, asymmetrical transmission line 10 is extended to encompass more than two sides of the truncated ground plane 50. This embodiment illustrates one of several approaches to conforming radiators to the form factor of the radio casing. In this example, the use of a meandering strip 87 results in a narrower bandwidth, but is offset with lower return loss.

Figure 13:
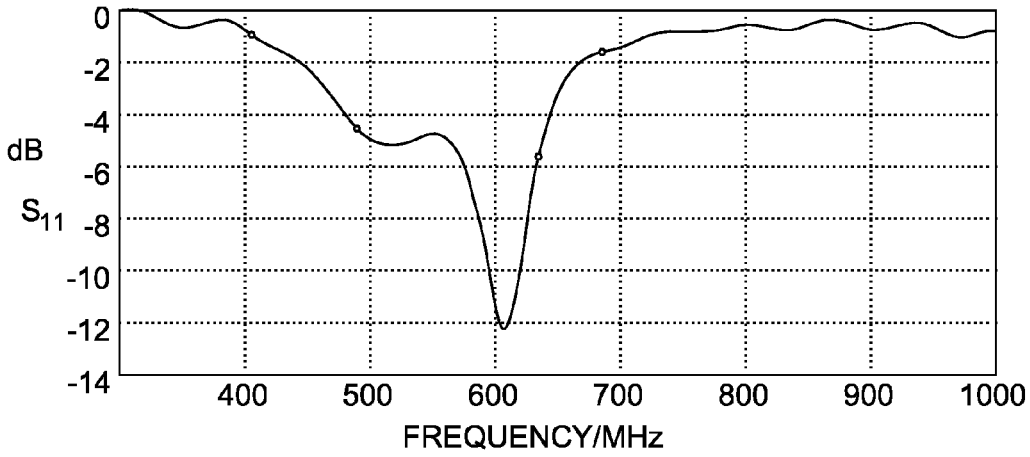
FIG. 13 is a $S_{11}$ plot of the embodiment of FIG. 12.

FIG. 13 is a $S_{11}$ plot at the point illustrated in FIG. 12. The wide bandwidth feature is evident with a −3 dB bandwidth approximately between 460 MHz and 650 MHz.

Figure 14:
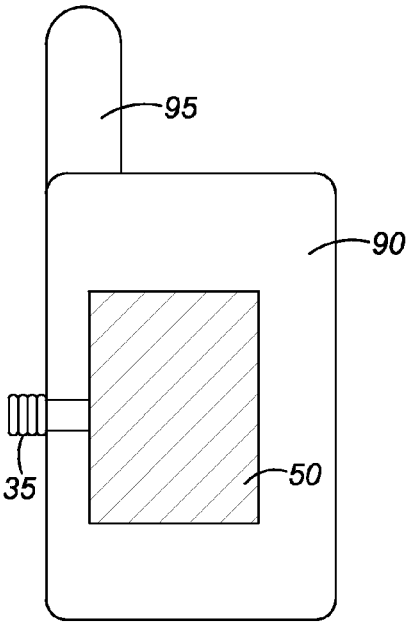
FIG. 14 is an illustration of an exposed backside of a mobile radio and a typical stub antenna.

FIG. 14 is an illustration of an exposed housing backside of a mobile radio 90 showing the ground plane 50 and a typical external stub antenna 95 with accompany signal coupler 35. This illustration will be used as a reference for the following FIGS.

Figure 15:
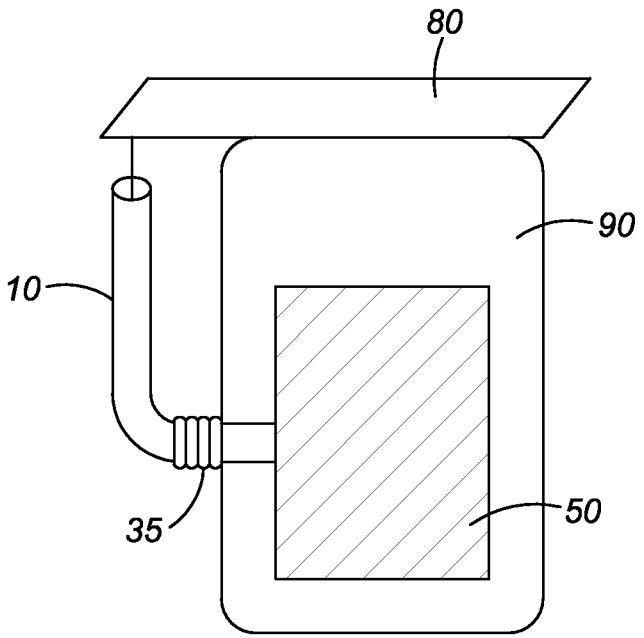
FIG. 15 is an illustration of an antenna embodiment utilizing the structure of a typical mobile radio with a ground plane and an exterior asymmetrical transmission line and top plate.

FIG. 15 is an illustration of an antenna embodiment utilizing the structure of a typical housing of a mobile radio 90 with ground plane 50, wherein an asymmetrical transmission line 10 is coupled to the signal coupler 35, riding the exterior of the housing of the radio 90 and connected to a top plate radiator 80.

Figure 16:
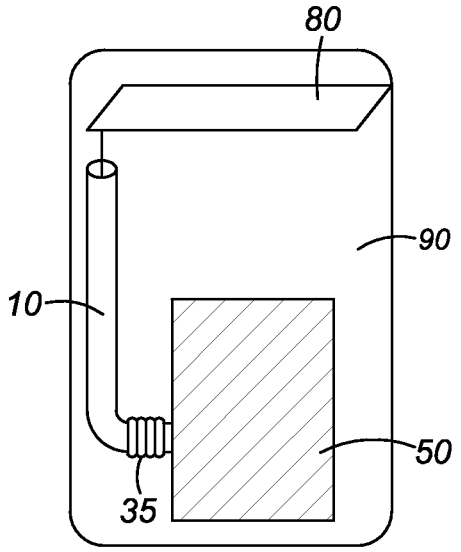
FIG. 16 is an illustration of another antenna embodiment utilizing the structure of a typical mobile radio with a ground plane and an interior asymmetrical transmission line and top plate.

FIG. 16 is an illustration of another antenna embodiment utilizing the structure of a typical housing of a mobile radio 90 with ground plane 50, wherein the asymmetrical transmission line 10 is coupled to the signal coupler 35, riding the interior of the housing of the radio 90 and connected to a top plate radiator 80. This embodiment contemplates sufficient spacing between the ground plane 50 and the mobile radio's 90 housing to allow placement of the asymmetrical transmission line 10. For most portable radio systems, there will be more than sufficient space between the ground plane 50 and the mobile radio's 90 housing.

Figure 17:
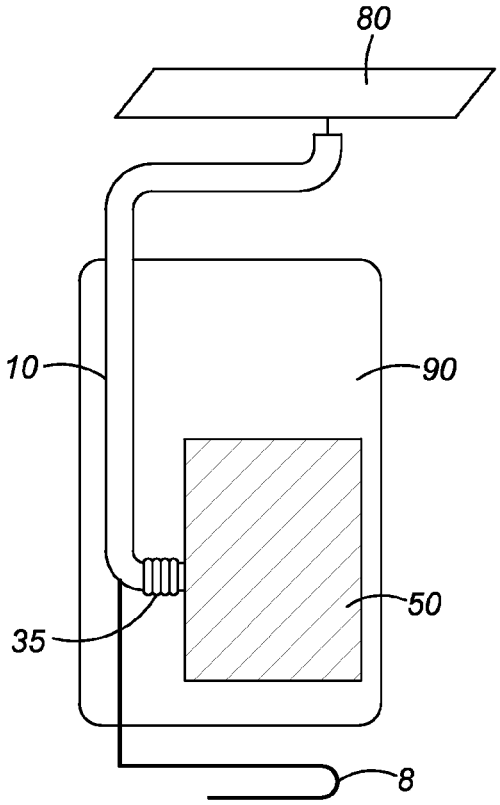
FIG. 17 is an illustration of another antenna embodiment utilizing the structure of a typical mobile radio with ground plane and top plate with wire ballast.

FIG. 17 is an illustration of another antenna embodiment utilizing the structure of a typical housing of a mobile radio 90 with ground plane 50, wherein the asymmetrical transmission line 10 is coupled to the signal coupler 35, riding the interior of the housing of the radio 90 and connected to a top plate radiator 80. In addition to the top plate radiator 80, a bottom folded line wire 8 is coupled to the asymmetrical transmission line 10, acting as a ballast antenna. It is noted that the connection to the top plate radiator 80 is shown as more to the center of the top plate radiator 80, than in the previous embodiments. It is understood that the feed point for the top plate radiator 80 is one of design preference, having known consequences and therefore alternative locations for feed pointing may be utilized without departing from the spirit and scope of this disclosure.

Experimental data showing performance characteristics for representative models tested for azimuthal gain for variations of the embodiments of FIGS. 14-17 are provided in the Table 1 below:

TABLE 1

| Relative Average gain comparison in azimuth in dB | 403 MHz (dBm) | 425 MHz (dBm) | 445 MHz (dBm) | 470 MHz (dBm) |
|---|---|---|---|---|
| Reference Ant. ~0 dbi | −26.5 | −25 | −24 | −22 |
| Malta radio (FIG. 14) – Reference Gain Summary | −31.2 | −28 | −26.5 | −23 |
| Sample 2 (FIG. 17) – floating coax + plate + ballast with 5 mm plate height – mid band | −32.5 | −27.5 | −24.5 | −22.2 |
| Sample 3 (FIG. 16) – fully internal floating coax + plate – mid band | | −27.4 | −26.7 | |
| Sample 4 (FIG. 17) – floating coax + plate + wire ballast with 1 cm plate height – 45 MHz bandwidth | −32.5 | −28.5 | −25 | −22.5 |

It should be appreciated that the various embodiments in the foregoing FIGS. illustrate that the asymmetrical transmission line radiator can be mated with various radiators (e.g., wire, cable, plate, meander, ballast, etc.), thus providing multiple degrees of freedom for an antenna engineer, allowing various configurations for deployment.

Figure 18:
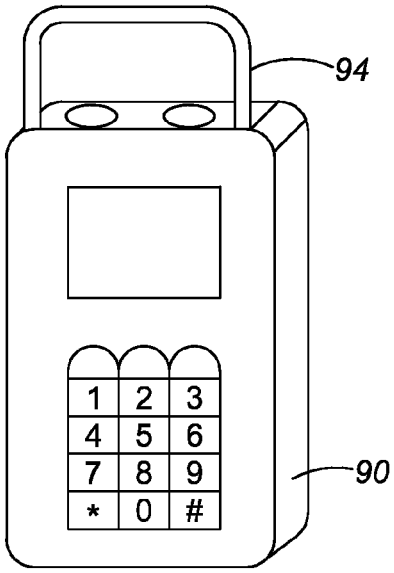
FIG. 18 is an illustration of another antenna embodiment of the front view of a typical mobile radio with the top plate antenna in the form of a thick U-shaped wire or ribbon.

FIG. 18 is an illustration of another antenna embodiment of the front view of a typical mobile radio 90, however the top plate antenna is in the form of a thick inverted U-shaped wire or similarly shaped "ribbon" 94 to reduce the overall height, as compared to a typical antenna (e.g., stub antenna, whip, etc.). This embodiment contemplates the asymmetrical transmission line (not shown) to be interior to the mobile radio 90. The antenna 94 additionally acts as a protective barrier to controls on the top of the mobile radio 90.

Figure 19:
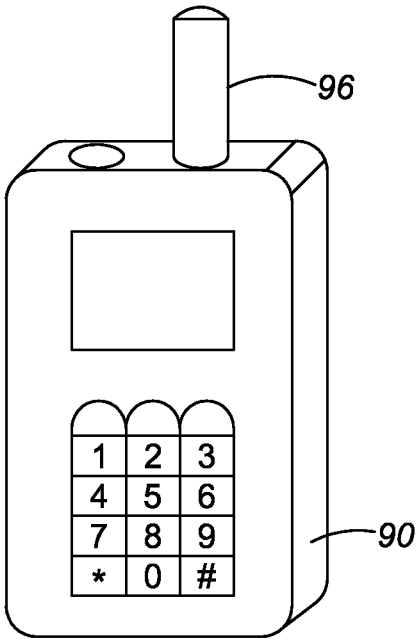
FIG. 19 is an illustration of another antenna embodiment of the front view of a typical mobile radio with the external antenna as a standard antenna fed by an asymmetrical transmission line.

FIG. 19 is an illustration of another antenna embodiment of the front view of a typical mobile radio 90, however the external antenna 96 can be a standard antenna 96 fed by the asymmetrical transmission line (not shown).

Figure 20:
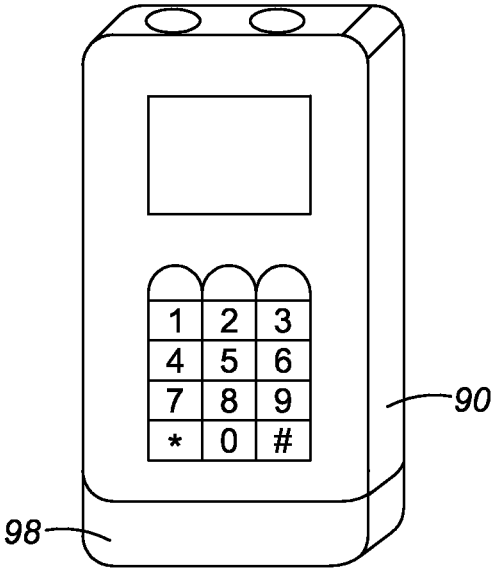
FIG. 20 is an illustration of another antenna embodiment of the front view of a typical mobile radio with a bottom "flat" antenna.

FIG. 20 is an illustration of another antenna embodiment of the front view of a typical mobile radio 90, however the top plate antenna 98 is situated at the bottom of the mobile radio 90. This embodiment contemplates the bottom situated antenna to also be a looped wire or a ballast antenna, as described in the previous FIGS.

The embodiments of FIGS. 18-20 illustrate that the final antenna can be configured in many ways, for example, a combination of an asymmetrical transmission line with wire antenna/plate antenna, top loaded or bottom loaded, internally/externally routed.

Figure 21:
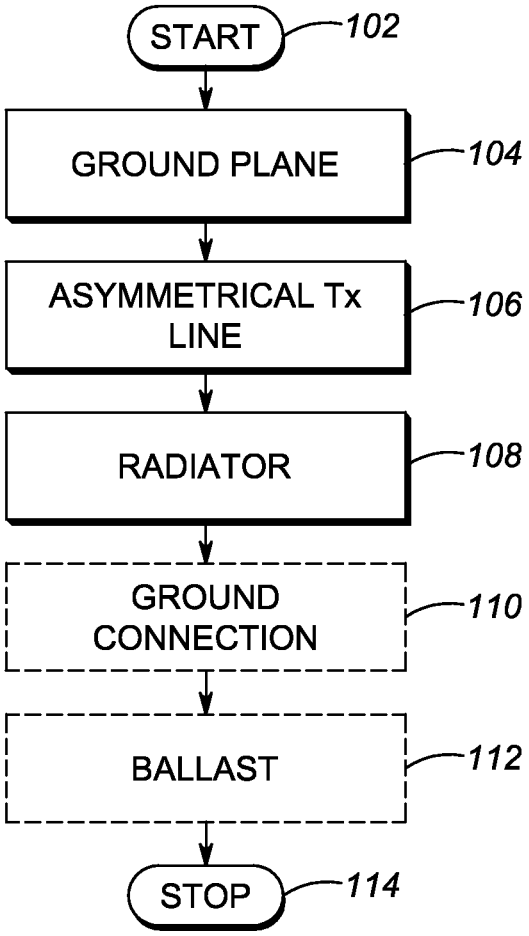
FIG. 21 is a flowchart illustrating a process flow for fabricating an antenna embodiment.

FIG. 21 is a flowchart illustrating a process flow for fabricating an antenna embodiment. The process starts 102 with obtaining 104 a truncated ground plane which may be in the form of a printed circuit board or other substrate used in a mobile radio system. Next, an asymmetric transmission line radiator 106 having a length ($L_{TL}$) is situated 106 substantially planar to and proximal to the truncated ground plane 104. The asymmetric transmission line radiator is devised so at one end it has an input/output connector suited for mating a radio RF coupler (not shown), to commute received and transmitted signals. The other end of the asymmetric transmission line radiator is coupled 108 via a feed point connection to an exciter antenna that may be in the form of a plate or bent wire. The feed point can be proximal to an edge of the truncated ground plane being in some embodiments interior an outside edge of the truncated ground plane but extending to the exterior, or other embodiments entirely exterior to the outside edge of the truncated ground plane, depending on design and performance preference.

The exciter antenna is disposed exterior to the edge of the truncated ground plane and, if having a plate antenna configuration, it is positioned in an orientation substantially orthogonal to the truncated ground plane, the exciter antenna having a larger dimension length ($L_{EA}$) that is at least 50% smaller than the length $L_{TL}$, wherein an overall length of a perimeter of the entire antenna embodiment is approximately ½ a wavelength of a center frequency of the antenna.

The process also accommodates the optional step (denoted with dashed lines) of attaching 110 a ground connection to an exterior of the asymmetric transmission line radiator, a position of the ground connection along the length $L_{TL}$ on the asymmetric transmission line radiator being understood to alter a center frequency of the antenna. Additional optional step (denoted with dashed lines) can be the 112 positioning of a secondary feed point of the asymmetric transmission line radiator below the truncated ground plane and coupling another exciter antenna, acting as a ballast, to the secondary feed point. After completion of step 108 or optional steps 110, 112, the process stops 114.

It is understood that while the embodiments described herein are stated in the context of radiating antennas, it is understood by one of ordinary skill in the art that antennas are by their very nature capable of both radiating and receiving, under the principle of duality. Therefore, while not explicitly stated as such, all of the embodiments are capable of receiving as well as transmitting. Also, while the embodiments are characterized for mobile UHF frequencies, other frequencies and/or bands are possible by altering the respective dimensions of the appropriate elements of the embodiments.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. An antenna, comprising:

a truncated ground plane;

an asymmetric transmission line radiator having a length $L_{TL}$ oriented substantially planar to and proximal to the truncated ground plane, the asymmetric transmission line having at one end an input/output connector, at an other end an unshielded feed point at least one of above the truncated ground plane and proximal to its edge, and a shielded portion in between the input/output connector and the feed point; and an exciter antenna in a form of a plate or bent wire physically coupled to the feed point and disposed exterior to the edge of the truncated ground plane and oriented substantially orthogonal to the truncated ground plane, the exciter antenna having a larger dimension length $L_{EA}$ that is at least 50% smaller than the length $L_{TL}$, wherein an overall length of a perimeter of the antenna is approximately ½ a wavelength of a center frequency of the antenna.

2. The antenna of claim 1, wherein the exciter antenna is displaced from the edge of the truncated ground plane by at least 0.05 wavelength.

3. The antenna of claim 1, wherein the perimeter of the antenna including the truncated ground plane is approximately 35 cm and the center frequency is approximately between 380 MHz and 520 MHz.

4. The antenna of claim 1, wherein the larger dimension length $L_{EA}$ is approximately between ¼-⅓ the length $L_{TL}$.

5. The antenna of claim 1, wherein the length $L_{TL}$ is a factor determining a center frequency of the antenna.

6. The antenna of claim 1, wherein the exciter antenna is located at a position below the truncated ground plane.

7. The antenna of claim 1, further comprising another connection to the feed point of the asymmetric transmission line disposed at a position below the truncated ground plane and another exciter antenna, acting as a ballast, coupled to the another feed point.

8. The antenna of claim 1, wherein the asymmetric transmission line forms a loop over the truncated ground plane.

9. The antenna of claim 1, further comprising a ground connection to a shield of the shielded portion of the asymmetric transmission line, a position of the ground connection along the length $L_{TL}$ on the asymmetric transmission line altering a center frequency of the antenna.

10. The antenna of claim 9, wherein the ground connection is proximal to the one end of the asymmetric transmission line.

11. The antenna of claim 1, further comprising at least one of a tuning and matching element disposed at the feed point.

12. The antenna of claim 1, further comprising a radio housing, wherein the asymmetric transmission line is disposed within the radio housing.

13. The antenna of claim 12, wherein the radio housing is sized for a hand-held radio.

14. The antenna of claim 1, wherein the exciter antenna is formed in a shape of an inverted-U.

15. The antenna of claim 1, wherein a characteristic impedance between an outer shield of the asymmetric transmission line and the truncated ground plane is greater than 100 Ohms.

16. The antenna of claim 1, wherein the length $L_{TL}$ of the asymmetric transmission line is approximately ⅙ an operating center wavelength in free space, and is approximately ¼ the operating center wavelength inside the asymmetric transmission line.

17. The antenna of claim 16, wherein the asymmetric transmission line's length $L_{TL}$ causes the asymmetric transmission line to operate as a ¼ wavelength transformer, adjusting a port impedance to approximately 50 Ohms.

18. A method for fabricating an antenna, comprising:

truncating a ground plane;

placing an asymmetric transmission line radiator having a length $L_{TL}$ substantially planar to and proximal to the truncated ground plane, the asymmetric transmission line having at one end an input/output connector, at an other end an unshielded feed point proximal to an edge of the truncated ground plane, and a shielded portion in between the input/output connector and the feed point; and physically coupling an exciter antenna in a form of a plate or bent wire to the feed point and disposing the exciter antenna exterior to the edge of the truncated ground plane in an orientation substantially orthogonal to the truncated ground plane, the exciter antenna having a larger dimension length $L_{EA}$ that is at least 50% smaller than the length $L_{TL}$, wherein an overall length of a perimeter of the antenna is approximately ½ a wavelength of a center frequency of the antenna.

19. The method of claim 18, further comprising attaching a ground connection to a shield of the shielded portion of the asymmetric transmission line, a position of the ground connection along the length $L_{TL}$ on the asymmetric transmission line altering a center frequency of the antenna.

20. The method of claim 18, further comprising positioning another connection to the feed point of the asymmetric transmission line below the truncated ground plane and coupling another exciter antenna, acting as a ballast, to the another feed point.

* * * * *